United States Patent [19]

Everitt

[11] Patent Number: 4,591,389

[45] Date of Patent: May 27, 1986

[54] FLUE CLEANING APPARATUS

[76] Inventor: Gary Everitt, Box 56 R.D. #3, Washington, N.J. 07882

[21] Appl. No.: 554,622

[22] Filed: Nov. 23, 1983

[51] Int. Cl.[4] ..... F23J 3/02

[52] U.S. Cl. ..... 134/8; 15/93 R; 15/104.1 R; 15/236 B; 15/242

[58] Field of Search ..... 15/23, 89, 91, 92, 93 R, 15/104.01 R, 104.1 R, 104.05, 104.09, 104.1 C, 104.14, 162, 163, 197, 198, 200, 242, 243, 249, 179; 29/81 J, 81 G, 90 R; 134/6, 8; 299/39, 40, 87, 88

[56] References Cited

U.S. PATENT DOCUMENTS

| | | | |
|---|---|---|---|
| 1,338,917 | 5/1920 | Hall | 15/162 |
| 1,903,520 | 4/1933 | Sturgis | 15/200 |
| 4,353,143 | 10/1982 | Beaudoin | 15/162 |
| 4,433,449 | 2/1984 | Rainey | 15/243 |

FOREIGN PATENT DOCUMENTS

| | | | |
|---|---|---|---|
| 5876 | 6/1879 | Fed. Rep. of Germany | 15/243 |
| 32304 | 8/1885 | Fed. Rep. of Germany | 15/243 |
| 572798 | 3/1933 | Fed. Rep. of Germany | 15/198 |
| 2155733 | 5/1973 | Fed. Rep. of Germany | 15/243 |
| 1165378 | 10/1958 | France | 15/200 |
| 2355479 | 6/1976 | France | 15/200 |

*Primary Examiner*—Edward L. Roberts

*Attorney, Agent, or Firm*—Donald N. Timbie

[57] ABSTRACT

Flue-cleaning apparatus having longitudinal springs mounted transversely on a flexible shaft at one end, the other end of the shaft being adapted to be clamped by the chuck of a hand-held drill.

7 Claims, 7 Drawing Figures

26
12
20
16
24

18
10
18
8
10
28
24
8
20
16

30
26
22
40
22
18
16
20
38
8
8
12
42
12
36
22
32
34
6
2
4

44
54
48
46
50

6
2
4
52

FLUE CLEANING APPARATUS

BACKGROUND OF THE INVENTION

The increased use of fireplaces and stoves for home heating in recent years has greatly increased the risk of fire because of the creosote deposited in the flue as the gases cool on their way up the chimney. It is not unusual for the hard tenacious deposit to reach a thickness of several inches in one heating season so as to reduce the cross-sectional area of an eight-inch flue to a few square inches. The variation in thickness of the deposit depends on a number of factors, but the thickest portion is usually several feet above the damper of a fireplace or the point where the pipe from a stove enters the chimney. Once the deposit is ignited, it becomes so hot that it can cause the building to catch fire. For these reasons, it is recommended that the creosote deposit be removed at least once a year, and preferably more often. However, because of the difficulty of using presently available flue-cleaning equipment, this is not generally done.

Three different types of apparatus have been suggested for cleaning flues. In a first type that is the one generally available, a scraper is moved up and down the flue. Examples of such apparatus are described in U.S. Pat. Nos. 1,256,402; 2,058,112; 4,353,143 and 4,128,758. In the first three patents, the scraper is mounted on the end of a shaft which is inserted in the chimney and pushed and pulled by the operator; and in the last patent, a permanent pulley system is installed at the top of the chimney whereby the scraper can be raised and lowered. With the scraper mounted on a shaft, the shaft must be so stiff in order to exert the required force on the scraper that it cannot easily bend around corners such as would be necessary if it were inserted into the flue through the damper of a fireplace or through a clean-out door at the bottom of the chimney. In most cases, this makes it necessary to insert the scraper through the top of the chimney so as to require the operator to climb on the roof. For many people this is practicably impossible and for all except those with considerable experience it presents a great risk of serious injury. Even a skilled person can inadvertently damage the roof. Furthermore, if the chimney has a cap, it must be removed before this procedure can be used.

Whereas these scraping devices may be of some use when the deposit in the flue is relatively thin, they are practically useless when the deposit is thick because if the scraper itself is stiff enough to remove a thin hard deposit from the flue, it is extremely difficult to move it along the flue where the deposit is thick. In fact, if there is a sudden restriction due to the creosote deposit, it may not be possible to move the scraper past it. Therefore, it will generally be necessary to climb on the roof and chip off the deposit with a stiff rod until the scraper can be made to pass through the flue. Scrapers are therefore capable of making the finishing touches but are not very helpful in doing the basic job.

Some scraping devices presently on the market have outwardly extending stiff prongs and are designed to have a rope attached to each end. In use, an operator on the roof pulls on one rope so as to move the device upward through the flue and another operator at the bottom of the chimney pulls on the other rope so as to move the device downward. Quite often, the device becomes stuck so that it is difficult to move it either way.

An additional disadvantage of this first type of device is that the cross-section of the scraper must fit the cross-section of the flue, thus requiring different expensive devices for flues of different sizes and shapes.

In a second type of device, the center of a circular brush is mounted coaxially on a shaft that is rotated, e.g., U.S. Pat. Nos. 589,012; 2,430,512; and 2,469,821. As with the first type of device, it is difficult or impossible to remove thick deposits. This is especially true when the thickness of the deposit suddenly increases because only the ends of the bristles of the brush can remove the deposit and they cannot be brought into contact with it. In such cases, the deposit must be dislodged by chipping it with a stiff rod from the top of the chimney. In addition to requiring brushes of different diameters for different sizes of flue, this type of device does not remove creosote from the corners so that the interior of a heavily encrusted flue has a circular cross-section when the operation is finished. The creosote left on the corners still presents a fire hazard. Even with stiff brushes, the deposit is so hard that a long time is required to wear it down.

In a third type of device, chains are attached to a shaft that is rotated so as to throw the end portions of the chains against the interior of the flue by centrifugal force, e.g., U.S. Pat. Nos. 1,917,383 and 3,120,020. Even though a flexible shaft is used so as to permit insertion of the chains beyond a point of curvature, e.g., the right angle bend that must be negotiated when the end of the shaft is inserted in the vertical clean-out door usually found at the bottom of a chimney, no centering of the end of the shaft occurs because the interior of the chimney cannot exert an inward force on a chain that will be transmitted to the shaft so as to center it. Furthermore, experiments have shown that there is a strong tendency for the chains to become wrapped around the shaft, thus forming a mass that bounces from one point to another on the flue in random fashion.

BRIEF SUMMARY OF THE INVENTION

In accordance with this invention, longitudinal springs are mounted transversely of the shaft. For the purpose of this patent application, a longitudinal spring is considered to be a spring that in its normal unstressed state extends along a given line, usually a straight line, and which attempts to align itself on the line when it is bent therefrom.

In a preferred embodiment of this invention, the longitudinal spring is a coiled compression spring that is screwed into an internally threaded hole in a mounting block until it is centered therein, and the block is attached to one end of a flexible shaft in such orientation that the spring is perpendicular to the shaft. This, in effect, creates two springs extending in opposite directions from the block. The other end of the shaft is of such size and shape that it can be easily gripped by the chuck of a hand-held drill. In another embodiment, the longitudinal springs are of the cantilever type and may be comprised of a flexible rod having its center attached to the mounting block and having disks concentrically mounted at each end of the rod in spaced relationship. Regardless of the type of longitudinal spring employed, its lateral stiffness should be low enough to permit its being revolved in the flue being cleaned with a torque less than the drill can exist. This is usally less than 20 foot-pounds. Regardless of the shape of the horizontal cross-section of the flue itself or the changes in that shape due to deposits of creosote, the opposing forces exerted on the springs by the interior surface of the flue will cause the shaft to be approximately centered therein when it is rotating. This means that the shaft will be able to follow the approximate center of the flue even though it has bends in it as in the case of a fireplace damper or where springs are inserted into the flue through the clean-out door at the base of the chimney.

In cleaning a typical home chimney flue having a square cross-section, the distance between the ends of the springs should at least equal the length of a diagonal and preferably should be about one inch longer. As the shaft revolves, the distance between it and the point where the spring contacts the wall of a square flue varies from a minimum when the base of a spring emerging from the block is in a first position where it is perpendicular to the wall to a maximum when the base of the spring is in a second position where it is in line with a diagonal. This change in the distance from the shaft to the point of contact not only results from centrifugal force exerted on the spring by the rotation of the shaft but also from the fact that the longitudinal springs tend to straighten out. Thus, the springs tend to force themselves into the corners as they rotate from the first position to the second. Generally there are a number of coils beyond the one making first contact with the creosote deposit that are forced into it by centrifugal force and spring action so as to form a number of cutting edges. Furthermore, when the springs encounter a steep shoulder in the creosote deposit, they are bent in umbrella fashion so as to conform to the shoulder, and the top portions of the coils or disks bite into the creosote.

The longitudinal spring could also be an elongation coiled spring such as used for keeping screen doors closed, but its centering and cleaning action is inferior to that of a compression spring.

Some advantages of this invention include the speed with which the flue can be cleaned, the ability to remove deposit from the corners and to bite into deposits having an abrupt increase in thickness, the low cost and the fact that the device can negotiate even right-angle bends. The greatest advantage, however, is that it is not necessary for the operator to climb on the roof, regardless of the thickness of the deposit of creosote.

DETAILED DESCRIPTION OF THE INVENTION

Figure 1:
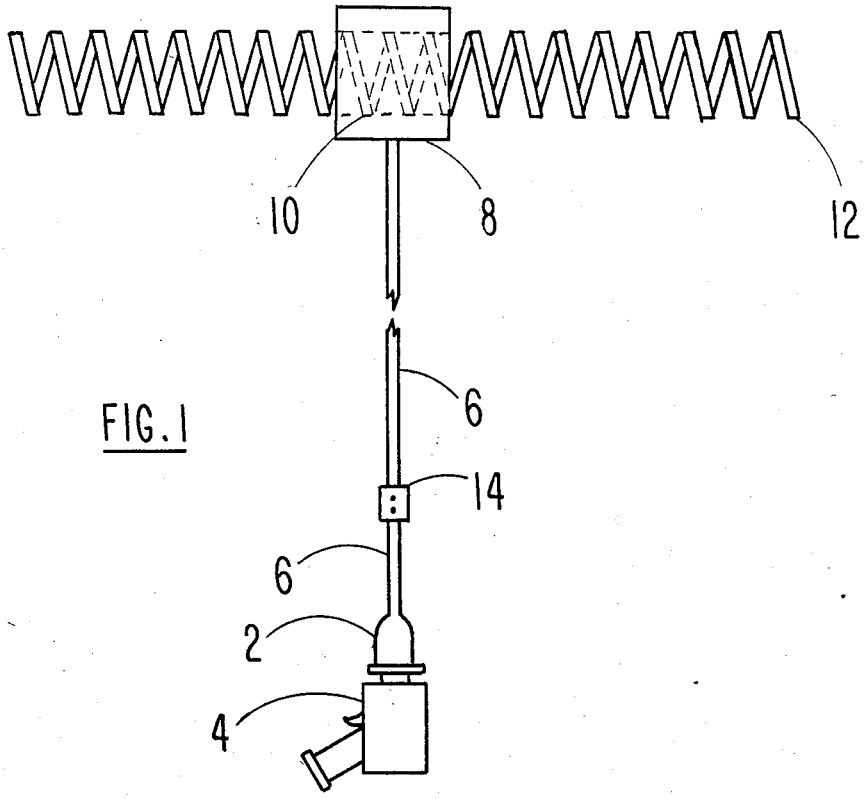
FIG. 1 illustrates a preferred form of chimney-cleaning apparatus constructed in accordance with this invention.

In FIG. 1, the chuck 2 of a small hand drill 4 is clamped to one end of a flexible shaft 6, and the other end of the shaft 6 is secured in any suitable manner, as by screw threads, to a block 8 having a hole 10 therein that is perpendicular to the shaft 6 and internally threaded so that a compression spring 12 may be screwed through it. The shaft 6 may be comprised of one piece or of a number of pieces attached at their adjacent ends like a fishing pole or by any suitable means, such as a clamp 14 or screw threads.

In cleaning an eight-inch flue, springs eleven inches in length and having the specifications of any of the springs 31-16, 31-17 and 31-18 in the chart below were found to give the best results when used with quarter-inch and three-eighth-inch hand-held drills. One important factor in the efficacy of the flue-cleaning device is the lateral stiffness of the spring, i.e., the force or bending moment that is required to bend it from its straight line axis. Because this characteristic is not generally specified, certain of the springs in the chart were subjected to a test in which an eleven-inch spring was centered in the block 8, which had a width of 5/16" along the axis of the spring, and a weight of nine ounces was hung from a free end of the spring. The right-hand column of the chart gives the amount by which the free end of the spring was depressed below the end at the block 8. Whereas stiffer springs will bite more deeply into the creosote deposit so as to speed up its removal, the stiffness can reach a point where the stall torque of the drill is exceeded so frequently as to actually decrease the rate of removal and run the risk of burning out the drill motor. If a motor having greater torque is used, it is possible that the flue will be severely chipped. On the other hand, as the lateral stiffness of the spring is reduced, more time is required to remove the deposit even though the shaft remains centered.

| Spring Number | Wire Diam. | Fits Hole | Fits Rod | Pitch | Comp. Load | Constant | Depression |
|---|---|---|---|---|---|---|---|
| 31-1 | .115 | 1½ | 1 3/16 | 11/16 | 73# | 128 | |
| 31-2 | .115 | 1¼ | ⅞ | 15/32 | 75# | 211 | |
| 31-3 | .115 | 1⅛ | ¾ | 9/32 | 50# | 302 | |
| 31-4 | .105 | 1⅛ | ¾ | 13/32 | 65# | 216 | |
| 31-5 | .105 | 1 | ⅝ | ¼ | 46# | 319 | |
| 31-6 | .105 | ¾ | ½ | 13/64 | 69# | 702 | |
| 31-7 | .091 | 1⅜ | 1 | 17/32 | 26# | 59 | |
| 31-8 | .091 | 1¼ | ⅞ | 15/32 | 33# | 89 | |

-continued

| Spring Number | Wire Diam. | Fits Hole | Fits Rod | Pitch | Comp. Load | Constant | Depression | | |
|---|---|---|---|---|---|---|---|---|---|
| 31-9 | .091 | 1⅛ | ¾ | 9/32 | 23# | 121 | | | |
| 31-10 | .091 | 1 | 11/16 | 9/32 | 31# | 166 | ⅞" | | |
| 31-11 | .091 | ¾ | 7/16 | ¼ | 70# | 444 | | | |
| 31-12 | .091 | ⅝ | 5/16 | 3/16 | 61# | 637 | | | |
| 31-13 | .080 | 1¼ | 1 | 7/16 | 11# | 32 | | | |
| 31-14 | .080 | 1 | ¾ | 7/16 | 30# | 85 | 2¼" | | |
| 31-15 | .080 | ⅞ | ⅝ | 5/16 | 33# | 143 | | | |
| 31-16 | .080 | ¾ | ½ | 9/32 | 30# | 148 | 1¾" | | |
| 31-17 | .080 | ⅝ | ⅜ | 3/16 | 43# | 339 | | | |
| 31-18 | .080 | ½ | ¼ | 5/32 | 57# | 666 | | Rec- | |
| 31-19 | .062 | 13/16 | ⅝ | ¼ | 11# | 57 | 2½" | om- | |
| 31-20 | .062 | ¾ | 9/16 | ¼ | 16# | 83 | | mend- | Usable |
| 31-21 | .062 | 11/16 | 7/16 | 3/16 | 16# | 130 | | ed | |
| 31-22 | .062 | ⅝ | ⅜ | 3/16 | 22# | 177 | | | |
| 31-23 | .062 | 9/16 | 5/16 | 3/16 | 33# | 265 | | | |
| 31-24 | .062 | ½ | 9/32 | 5/32 | 36# | 387 | | | |
| 31-25 | .062 | 7/16 | ¼ | ⅛ | 34# | 550 | completely down | | |
| 31-26 | .032 | ⅜ | ¼ | ⅛ | 5# | 52 | | | |
| 31-27 | .032 | 5/16 | 7/32 | ⅛ | 7# | 82 | | | |
| 31-28 | .032 | ¼ | 5/32 | 3/32 | 11# | 188 | | | |
| 31-29 | .032 | 7/32 | ⅛ | 1/16 | 9 6/10# | 316 | | | |
| 31-30 | .026 | 3/16 | 3/32 | 1/16 | 8 3/10# | 228 | | | |
| 31-31 | .026 | ⅛ | 1/16 | 3/64 | 16¾# | 836 | | | |

Although a little experience will indicate the useful specifications of the shaft 6, good results have been obtained with a cold-rolled round steel shaft of 5/32" diameter and with a polished round steel shaft of ⅛" diameter. Flexible transmission lines like that used with speedometer cables of automobiles and having a diameter of about ⅜" or ½" could be used for the shaft.

Figures 2A, 2B, 2C, 3:
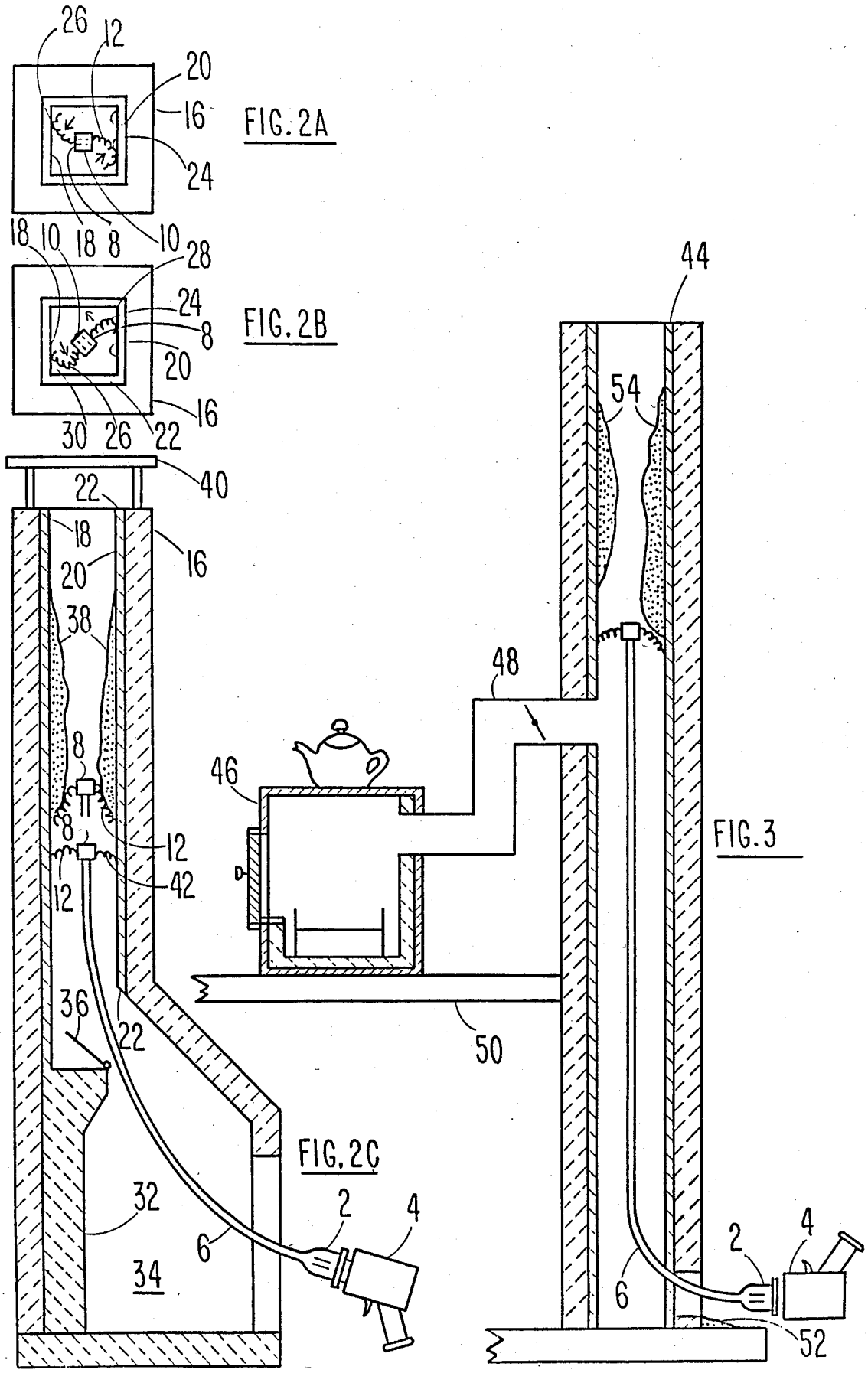
FIG. 2A is a cross-section view of a chimney showing the springs used in this invention striking the sides of a chimney flue.
FIG. 2B is a cross-section view of a chimney showing the springs used in this invention striking corners of a chimney flue.
FIG. 2C is a cross-sectional elevation of a chimney having a fireplace communicating with its flue and illustrates the position the flue-cleaning apparatus of this invention would have in operation.
FIG. 3 is a cross-sectional elevation of a chimney having a stove communicating with its flue and illustrates the position the flue-cleaning apparatus of this invention would have in operation.

Reference is now made to FIGS. 2A, 2B and 2C for an explanation of the manner in which the chimney flue cleaner of this invention operates to clean a flue having a square cross-section. In the top view of a chimney 16 shown in FIG. 2A, the threaded hole 10 in the block 8 through which the spring 12 is threaded is oriented perpendicularly to the side walls 18 and 20 of the flue liner 22 and is rotating in the direction of the arrows. Because the distance between the ends of the spring 12 is greater than the diagonal of the flue liner 22, the end portions 24 and 26 scrape across the walls 18 and 20 respectively. In FIG. 2B, the threaded hole 10 has rotated farther so that the end portions 24 and 26 of the spring 12 are about to scrape across the corners 28 and 30 of the flue liner 22. The lateral force exerted on the creosote by the end portions 24 and 26 of the spring 12 depends in part on their centrifugal force and in part on the tendency of the spring 12 to straighten itself out. The greater the lateral stiffness of the spring, the greater is the force and the deeper is the bite of the coils of the spring that are in contact with the creosote. As the spring 12 rotates from the position shown in FIG. 2A to the position shown in FIG. 2B, the walls of the flue liner 22 along a line through the threaded hole 10 get farther away from the center so that the spring 12 tends to straighten out. In doing so, the end portions 24 and 26 fly into the corners 28 and 30 of the flue liner 22 with considerable force and remove the creosote deposit therefrom.

In order to clean the corners in the manner just described, the length of the spring 12 must be at least equal to the diagonal dimension of the flue and preferably a little greater. In the case of the eight-inch flues used for various tests, the diagonal varied from 9 to 10 inches and the spring 12 was eleven inches long. Experiments with a spring 12 having a length of 13 inches obtained less favorable results, and it is thought that this was caused by the reduction in the speed with which the spring 12 straightened out.

FIG. 2C is a vertical section of the chimney 16 of FIGS. 2A and 2B illustrating the manner in which the device of this invention may be used to clean a fireplace flue. Although not always present, a rain shelf 32 is shown at the rear of a fire box 34, and a damper 36 (shown in open position) is mounted for rotation at the upper and inner corner of the rain shelf 32. Whereas the fireplace flues are generally greater than eight inches and may have a rectangular as opposed to square cross-section, the principles of operation are just the same. In cleaning such flues, the spring 12 would have to be proportionately longer and its lateral stiffness should be greater if the deposit is to be removed in a reasonable time.

From FIG. 2C, it can be seen how difficult, if not impossible, it would be to ram a scraper through the fire box 34 and into the flue via the opening for the damper 36 and move it up and down with sufficient force to remove a deposit 38 of creosote. It would be particularly difficult to scrape the near wall 20 of the flue. For these reasons, it would be easier to operate the scraper through the top of the chimney 16, but if the chimney 16 is provided with a cap 40, the cap must be removed and this is often difficult to do.

With the flue-cleaning apparatus of this invention, there is no need to climb on the roof. The operator kneels on the hearth and thrusts the shaft 6 through the fire box 34 and the damper opening until the spring 12 is located vertically in the flue 22 as shown in the lower position. The drill 4 is then energized so as to cause the spring 12 to rotate and center the shaft 6.

If the spring 12 is laterally stiff, such as the springs 31-16, 31-17 and 31-18 in the above chart, it will extend from the shaft 6 and strike the wall of the flue 22. But if the spring 12 has little lateral stiffness, such as the spring 31-25, it will generally hang downward along the shaft 6. In either case, the spring 12 will push against opposite walls of the flue 22, as indicated in FIG. 2C, when the drill 4 is energized so as to force the shaft 6 to the approximate center of the flue 22. It is now possible to clean all walls of the flue, including the near wall 20 and the corners as well. The operator then thrusts the shaft farther up the flue 22 until he senses that the spring 12 is biting into the deposit 38 as indicated by the upper position of the spring 12. If the drill slows down appreciably, it is only necessary to withdraw the shaft 6 slightly. With a tall chimney, the shaft 6 may have to be lengthened from time to time by adding sections.

In FIG. 2C, the end portions 24 and 26 of the spring 12 cannot be easily illustrated. When the shaft 6 is inserted far enough into the flue 22, as shown by the upper position of the spring 12, the upper sides of the coils of the spring 12 that are respectively adjacent the end portions 24 and 26 are bent downward somewhat like the ribs of an umbrella and bite into the deposit 38. Because of this action, the shaft 6 can be gradually inserted farther up the flue until practically all of the deposit 38 is removed.

FIG. 3 illustrates the manner in which the device of this invention could be used to clean a flue 44 to which the fire box of a stove 46 is coupled via a stove pipe 48. In such installations, the stove 46 may be mounted on a floor 50 of the building and the flue 44 extends below the floor 50 to ground level. A clean-out door 52 at the base of the chimney provides access to the bottom of the flue. Even if a scraper were attached to a strong flexible rod, it would be difficult indeed to insert the scraper through the clean-out opening so as to reach the creosote deposit 54; and even if this were done, it might be difficult to apply enough force to remove the deposit 54 even if it did not have a sudden increase in thickness as shown.

Cleaning the flue 44 with the device of this invention is relatively easy and fast. The shaft 6 is thrust through the clean-out door 52 until it is past the point where the stove pipe 48 enters. The drill 4 is energized and the creosote deposit 54 is removed as previously described.

Figure 4:
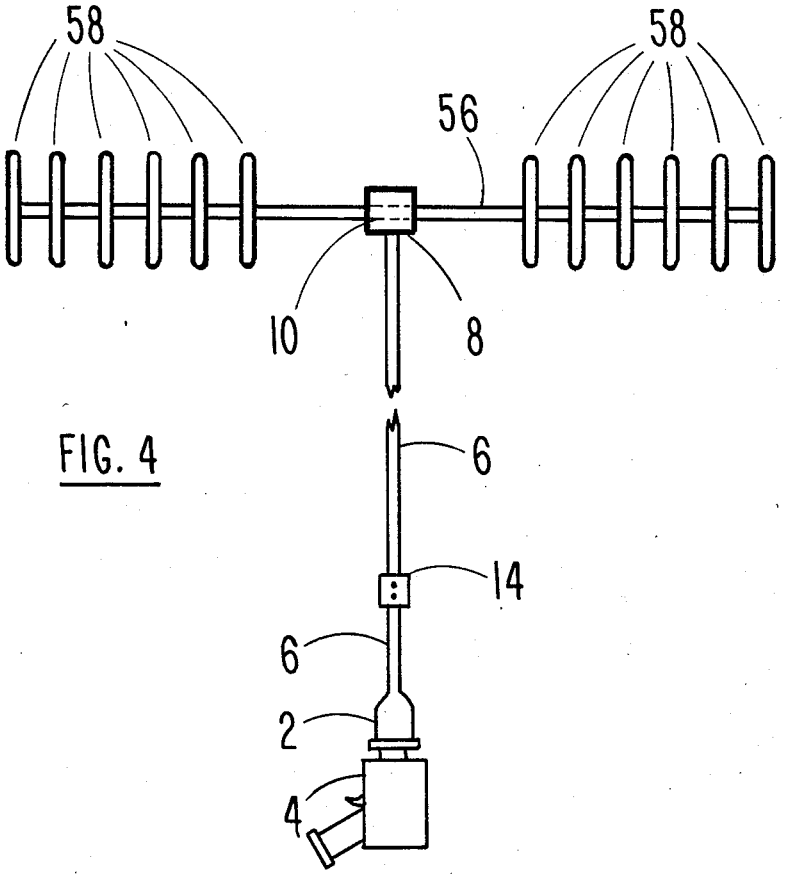
FIG. 4 illustrates an alternative form of the chimney-cleaning apparatus of this invention in which the longitudinal spring is of the cantilever type.
Figure 4A:
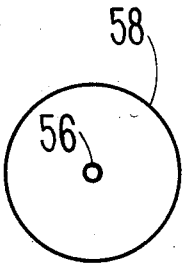
FIG. 4A shows an end view of the disk of FIG. 4.

FIG. 4 illustrates an embodiment of the invention in which the longitudinal spring is of the cantilever type, herein shown as a rod 56 of spring steel that is mounted by threading or a press-fit into the hole 10 in the block 8. Disks 58 are concentrically mounted on the rod 56 in spaced relationship. Many disks could be used, if desired. FIG. 4A is an end view of the rod 56 and one of the disks 58. When the rotation shaft is inserted in the flue, the longitudinal spring, herein the rod 56, bends so that the edges of the disks bite into the creosote in a manner similar to the individual coils of the embodiment of FIG. 1. When the rod 56 is perpendicular to the walls of the flue, a number of disks beyond the first one that makes contact will scrape along the wall, and as the rod 56 rotates to a position beyond a diagonal of the flue, successive disks 58 are the first ones to make contact with the wall, and the end disk will sweep into the corner of the flue so as to remove creosote or other material therefrom.

What is claimed is:

1. Apparatus for cleaning chimney flues, comprising
a flexible shaft,
means defining a plurality of coiled compression springs, and
means for respectively attaching said springs to said shaft such that the springs are transverse thereto and have free ends.

2. Appparatus as set forth in claim 1 wherein the end of the shaft remote from the springs is of such size and shape as to be securely gripped by the chuck of a standard quarter-inch drill.

3. Apparatus as set forth in claim 1 wherein the distance between the ends of the springs is at least equal to the length of the maximum dimension of the cross-section of the chimney flue being cleaned.

4. Apparatus for cleaning chimney flues, comprising
a flexible shaft,
means defining a plurality of coiled compression springs,
means for respectively attaching said springs to said shaft such that the springs are transverse thereto and have free ends, and
said springs being such that a weight of nine ounces suspended from any of said springs at a point that is 5 11/32 inches from the attaching means causes a downward deflection at the point of suspension of between $\frac{7}{8}$ and $3\frac{1}{2}$ inches when the shaft is vertical.

5. Apparatus for cleaning chimney flues, comprising
a shaft,
means defining a plurality of longitudinal springs symmetrically mounted transversely to said shaft, said shaft being adapted to be rotated by a motor,
the bending moment of said springs being such that they can be rotated with a torque of less than twenty foot-pounds in an opening having a cross-section with a minimum dimension equal to one-half the distance between the ends of the springs.

6. Apparatus for cleaning chimney flues comprising:
a flexible shaft,
a flexible rod, the center of said rod being attached to said shaft so that the rod is transverse to the shaft, and
a plurality of disks mounted transversely to said rod.

7. A method of cleaning a rectangular chimney flue, comprising
mounting a plurality of compression spring means transversely to one end of a shaft so that they are perpendicular thereto and have free end portions,
attaching a rotary motor to the other end of the shaft,
inserting the springs into the near end of the flue,
causing the motor to turn the shaft so that the shaft is centered in the flue by the inward forces exerted on the end portions of the springs by the sides of the flue, and
advancing the springs into the flue as the springs remove any deposit that may be therein.

* * * * *